US009120005B2

(12) United States Patent
Hansen

(10) Patent No.: US 9,120,005 B2
(45) Date of Patent: Sep. 1, 2015

(54) DEVICE FOR LIMITING ROTATION OF A WHEEL

(71) Applicant: Roger Hansen, Tulsa, OK (US)

(72) Inventor: Roger Hansen, Tulsa, OK (US)

( * ) Notice: Subject to any disclaimer, the term of this patent is extended or adjusted under 35 U.S.C. 154(b) by 0 days.

(21) Appl. No.: 14/140,943

(22) Filed: Dec. 26, 2013

(65) Prior Publication Data

US 2014/0182979 A1 Jul. 3, 2014

Related U.S. Application Data

(60) Provisional application No. 61/746,349, filed on Dec. 27, 2012.

(51) Int. Cl.

| | |
|---|---|
| ***A63C 17/01*** | (2006.01) |
| ***A63C 17/14*** | (2006.01) |
| ***A63C 17/00*** | (2006.01) |

(52) U.S. Cl.

CPC ..... *A63C 17/1445* (2013.01); *A63C 17/002* (2013.01); *A63C 17/1418* (2013.01); *A63C 2201/02* (2013.01)

(58) Field of Classification Search

CPC . A63C 17/14; A63C 17/1409; A63C 17/1445

USPC ..... 188/2 R, 4 R, 5, 29; 280/11.204, 11.206, 280/11.207, 11.211, 11.212, 11.215, 280/11.217, 87.042

See application file for complete search history.

(56) References Cited

U.S. PATENT DOCUMENTS

| | | | | | |
|---|---|---|---|---|---|
| 2,631,861 | A | * | 3/1953 | Daniska | 280/11.208 |
| D242,938 | S | | 1/1977 | Famolare, Jr. | |
| 4,003,582 | A | | 1/1977 | Maurer | |
| 4,027,890 | A | * | 6/1977 | Volkmann | 280/11.207 |
| 4,037,852 | A | | 7/1977 | Bayer et al. | |
| 4,084,831 | A | | 4/1978 | Akonteh et al. | |
| 4,088,334 | A | * | 5/1978 | Johnson | 280/11.206 |
| 4,413,842 | A | | 11/1983 | Loredo | |
| 5,803,473 | A | * | 9/1998 | Bouden | 280/87.042 |

(Continued)

FOREIGN PATENT DOCUMENTS

| | | |
|---|---|---|
| KR | 1009857320000 | 9/2010 |
| WO | WO03051473 | 6/2003 |
| WO | 2011008108 | 1/2011 |

OTHER PUBLICATIONS

International Search Report and the Written Opinion of the International Searching Authority; Korean Intellectual Property Office, Republic of Korea, Apr. 22, 2014.

*Primary Examiner* — Christopher Schwartz

(74) *Attorney, Agent, or Firm* — Head, Johnson & Kachigian, P.C.

(57) ABSTRACT

A device for limiting rotation of a wheel, such as a wheel on a skateboard, comprising a physical stop secured against one wheel of the skateboard. Multiple physical locks may be used, each secured against single wheel. The physical stop may comprise a block of resilient material placed in a semi-compressed state into the gap between the skateboard deck and the wheel such that the block exerts pressure on the wheel sufficient to prevent the wheel from freely rotating. Alternately, the physical stop may comprise a holder at least partially surrounding the wheel and at least one protrusion from the holder adjacent a rolling surface of the wheel, where the protrusion is capable of functioning as a chock and substantially preventing the wheel from rolling against a surface.

23 Claims, 18 Drawing Sheets

(56) References Cited

U.S. PATENT DOCUMENTS

| | | | | |
|---|---|---|---|---|
| 5,924,733 | A | | 7/1999 | Palleschi |
| 6,007,074 | A | * | 12/1999 | Tarng ..... 280/11.115 |
| D481,433 | S | | 10/2003 | Guerra et al. |
| 6,820,881 | B1 | | 11/2004 | Berry |
| 7,070,192 | B1 | | 7/2006 | Steiner |
| 7,159,879 | B2 | | 1/2007 | Cole |
| 7,237,784 | B1 | | 7/2007 | Monteleone |
| 7,341,260 | B1 | | 3/2008 | Hosoda et al. |
| 8,127,895 | B2 | | 3/2012 | Keating |

* cited by examiner

DEVICE FOR LIMITING ROTATION OF A WHEEL

CROSS REFERENCE

This application is based on and claims priority to U.S. Patent Application No. 61/746,349 filed Dec. 27, 2012.

BACKGROUND OF THE INVENTION

1. Field of the Invention

This invention relates generally to a device for limiting rotation of a wheel, and more particularly, but not by way of limitation, to a device that may be placed onto the individual wheels of a skateboard to limit rotation of the wheels.

2. Description of the Related Art

A typical skateboard has a deck, two trucks, and four wheels. In its simplest form, riding a skateboard involves standing on the deck and pushing off the ground to propel the skateboard along the ground on the wheels. It is common, however, for skateboard riders to perform tricks that involve the wheels of the skateboard leaving the ground. These tricks, and even tricks for which the wheels do not leave the ground, require balance and particular movements, both of which may be perfected through extensive practice. The wheels of the skateboard complicate such practicing, as performing a trick incorrectly or incompletely could result in the skateboard rolling away, causing the rider to fall.

Several training aids have been developed to address this problem. These typically require some modification of the skateboard, such as removing the wheels or adding additional elements. These modifications may be difficult and, more importantly, may change how the skateboard functions in some significant way: make the skateboard heavier, prevent access to elements such as the underside of the deck for balancing tricks, prevent the proper functioning of the trucks, etc. Thus, once the modifications are removed, the skateboard no longer behaves how it did when the rider was practicing, forcing the rider to re-learn certain elements.

Based on the foregoing, it is desirable to provide a device that limits the rotation of the wheels of the skateboard so that the skateboard cannot roll while the rider practices tricks.

It is further desirable for the device to allow the user to learn tricks, develop muscle memory, train reflexes, and get over fear.

It is further desirable for the device to be easy to install without tools and without removing parts or otherwise modifying the skateboard, allowing the device to be temporarily installed to the skateboard, such that it stays in place while the rider performs tricks, and easily removed so that the rider can resume normal operation of the skateboard.

It is further desirable for the device to be lightweight so that it does not affect the weight and general feel of the skateboard and does not change the center of gravity of the skateboard.

It is further desirable for the device to work with a variety of skateboard dimensions and configurations.

It is further desirable for the device to allow access to the center, nose, and tail areas of the board, allowing for contact with surfaces and obstacles such as rails, stairs, and platforms.

SUMMARY OF THE INVENTION

In general, in a first aspect, the invention relates to a device for use with a wheeled device comprising a deck and at least one wheel attached to the deck with a gap between the wheel and the deck, such as a skateboard, the device comprising a physical stop secured against one wheel of the skateboard. The skateboard may comprise multiple wheels and the device may comprise multiple physical stops, each physical stop secured against one wheel.

The physical stop may comprise a block of resilient material, where the block is thicker than the gap between the wheel and the deck and is capable of being placed in a semi-compressed or compressed state into the gap such that the block exerts pressure on the wheel sufficient to prevent the wheel from freely rotating. The block may be wider or narrower than the wheel, and may be generally parallelepiped-shaped with a recess corresponding to the wheel's location when the block is in place in the gap. The block may have an angled top surface, and may have cut out areas running horizontally through the block. The block may have a bottom surface in contact with the wheel and the bottom surface may have a coating of a material with a higher coefficient of friction than the block. The block may have at least one surface with a coating having at least one physical characteristic different from that of the block.

The physical stop may comprise a holder at least partially surrounding the wheel and at least one protrusion from the holder, where the protrusion is adjacent a rolling surface of the wheel and is capable of functioning as a chock when the protrusion is in contact with a surface upon which the wheel is attempting to roll and where the holder secures the protrusion to the wheel such that the protrusion moves with the wheel. The holder may be generally cylindrical and may surround the rolling surface of the wheel. The holder may be made of an elastic material capable of deforming for placement around the wheel but conforming to the shape of the wheel to fit securely around the wheel such that the holder prevents the wheel from rotating when on a surface. The holder may have an inner surface with a generally cylindrical cross section and an outer surface with a generally rectangular cross section. The protrusions may run crosswise along the width of the wheel, perpendicular to a path of rotation of the wheel. The holder may surround the wheel from the sides, with the protrusions extending between the sides across the rolling surface of the wheel.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a device for limiting rotation of a wheel for a skateboard. A typical skateboard has a deck 1 and two trucks 2, each of which has two wheels 3. The trucks 2 connect the wheels 3 to the underside of the deck 1 and pivot to allow the skateboard to turn. While this typical skateboard configuration is shown in FIGS. 1, 8, 12, 17, and 22, the skateboard device of the present invention may be used with any other skateboard design, including any number of wheels attached by any means, with or without trucks, to a deck or other platform of any shape and size.

Figure 1:
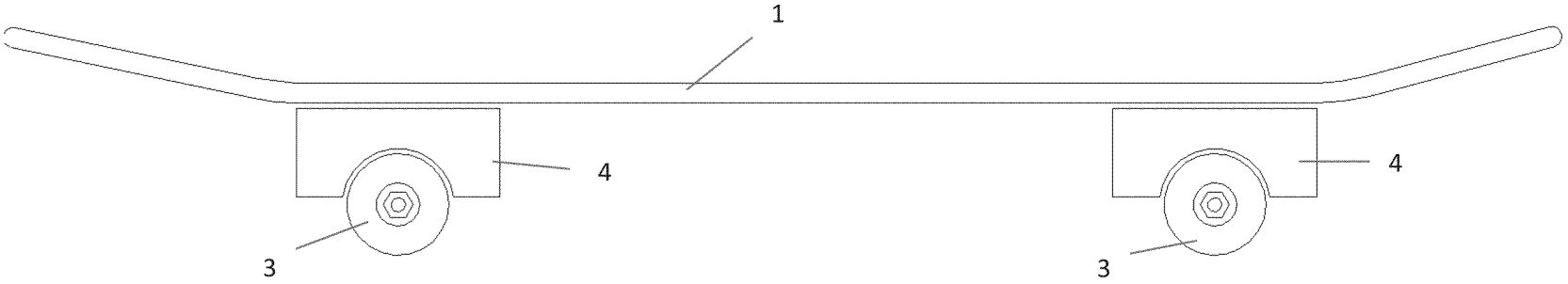
FIG. 1 is a side view of a skateboard with block-type devices for limiting rotation of a wheel.

The device for limiting rotation of a wheel is generally a physical stop secured against one of the wheels 3 of the skateboard. As seen in FIG. 1, the device may be a block 4 of resilient material, such as foam rubber, that may be wedged between the deck 1 and a wheel 3. The block 4 may be compressed for placement between the deck 1 and wheel 3, then released once in place to allow the block 4 to expand to fill the area between the deck 1 and wheel 3, thus placing pressure on the wheel 3 sufficient to prevent the wheel 3 from freely rotating.

FIG. 1 shows multiple blocks 4 in place between the deck 1 and wheels 3. One block 4 may be used with each of the wheels 3 of a skateboard, or a larger block 4 may be used in conjunction with multiple wheels 3. Each block 4 may be wider than the width of the wheel 3 and thicker at its thinnest point than the distance between the deck 1 and wheel 3. This allows the block 4 to maintain sufficient compression once installed between the deck 1 and wheel 3 to exert pressure upon the wheel 3 and impede its rotation.

Figure 2:
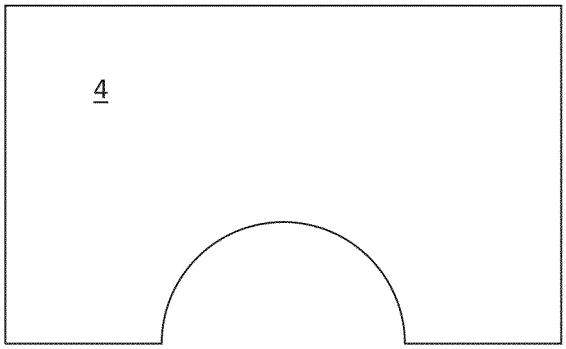
FIG. 2 is a side view of a block-type device for limiting rotation of a wheel with a semi-circular recess.
Figure 3:
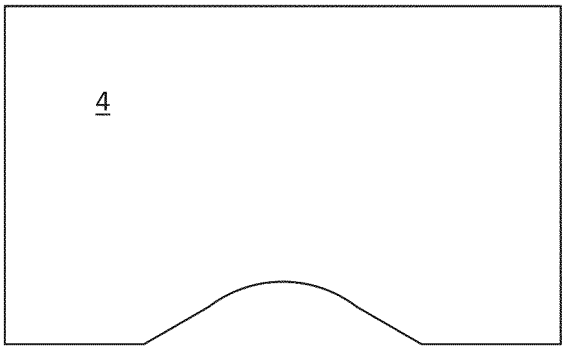
FIG. 3 is a side view of a block-type device for limiting rotation of a wheel with a sloped recess.
Figure 4:
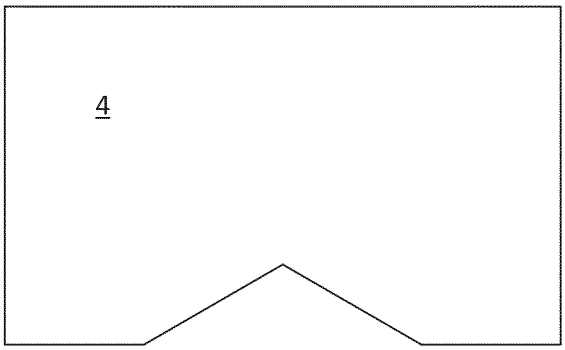
FIG. 4 is a side view of a block-type device for limiting rotation of a wheel with a v-shaped recess.
Figure 5:
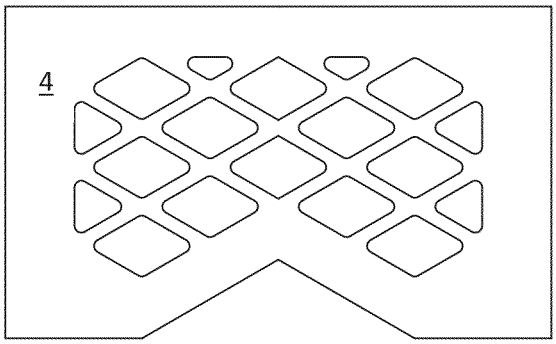
FIG. 5 is a side view of a block-type device for limiting rotation of a wheel with a v-shaped recess and lattice cut-outs.
Figure 6:
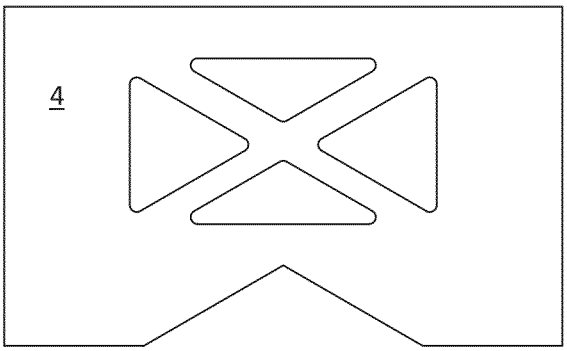
FIG. 6 is a side view of a block-type device for limiting rotation of a wheel with a v-shaped recess and triangular cut-outs.
Figure 7:
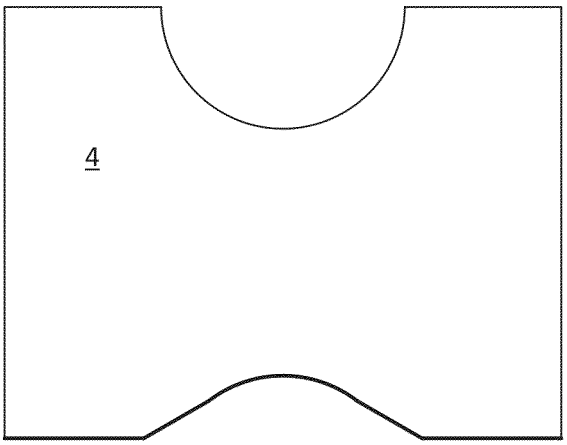
FIG. 7 is a side view of a block-type device for limiting rotation of a wheel with top and bottom recesses.
Figure 8:
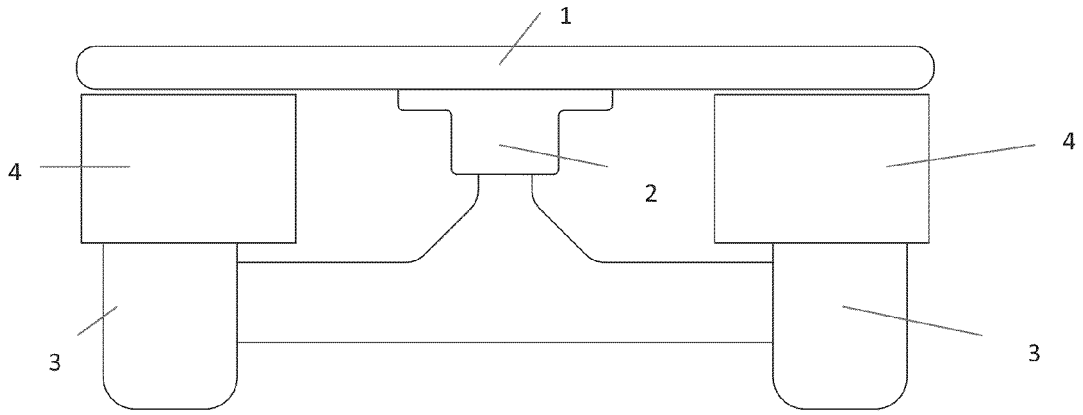
FIG. 8 is an end view of a skateboard with block-type devices for limiting rotation of a wheel with square cross sections.
Figure 9:
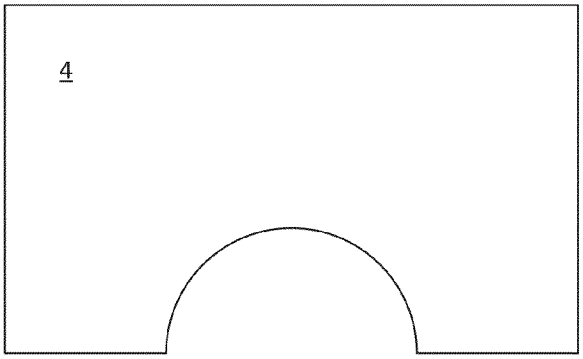
FIG. 9 is a side view of a block-type device for limiting rotation of a wheel with a square cross section.
Figure 10:
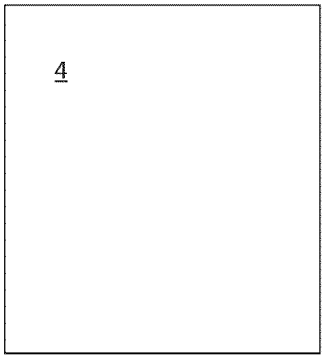
FIG. 10 is an end view of a block-type device for limiting rotation of a wheel with a square cross section.
Figure 11:
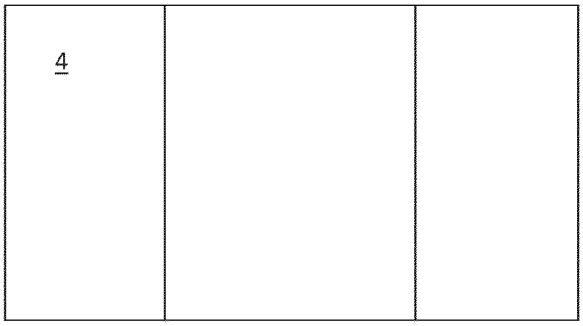
FIG. 11 is bottom view of a block-type device for limiting rotation of a wheel with a square cross section.
Figure 12:
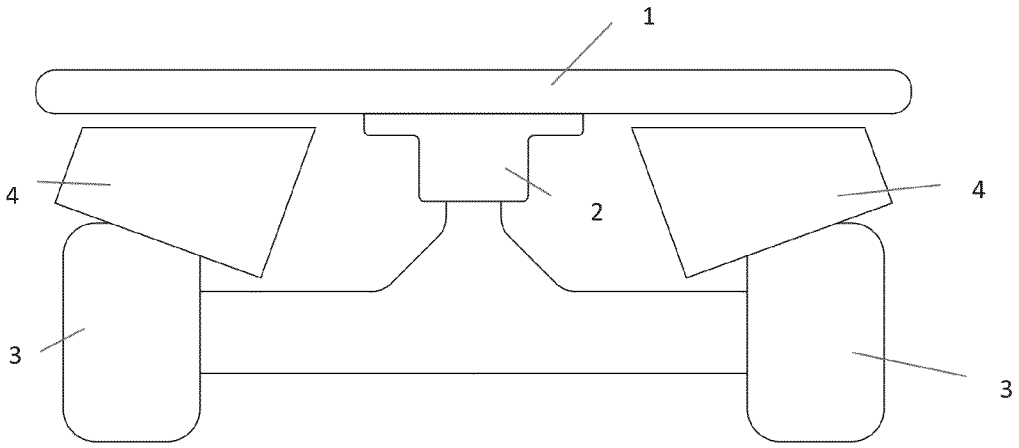
FIG. 12 is an end view of a skateboard with block-type devices for limiting rotation of a wheel with angled cross sections.
Figure 13:
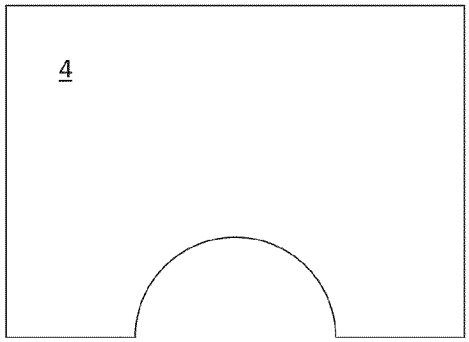
FIG. 13 is a side view of a block-type devices for limiting rotation of a wheel with an angled cross section.
Figure 14:
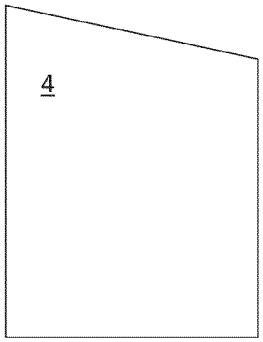
FIG. 14 is an end view of a block-type device for limiting rotation of a wheel with an angled cross section.
Figure 15:
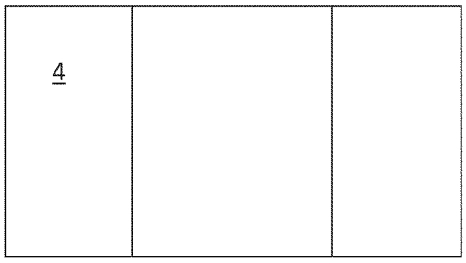
FIG. 15 is a bottom view of a block-type device for limiting rotation of a wheel with an angled cross section.
Figure 16:
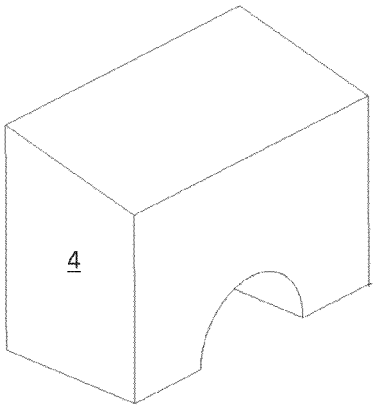
FIG. 16 is a perspective view of a block-type device for limiting rotation of a wheel with an angled cross section.
Figure 17:
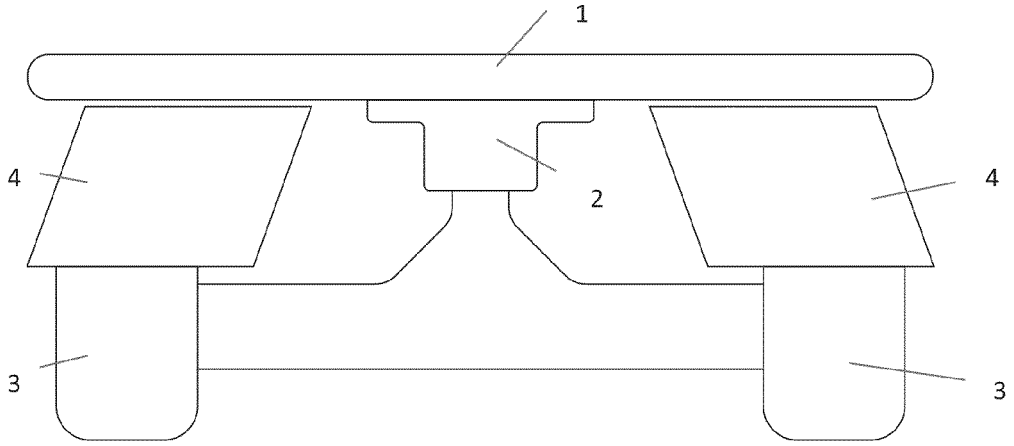
FIG. 17 is an end view of a skateboard with block-type devices for limiting rotation of a wheel with parallelogram cross sections.
Figure 18:
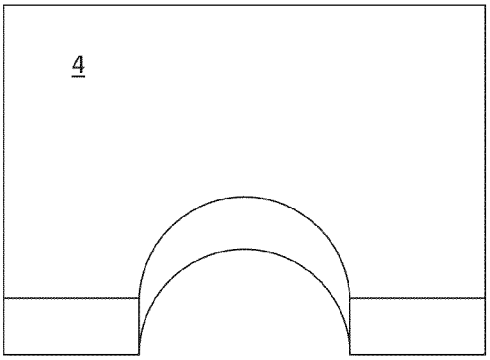
FIG. 18 is a side view of a block-type device for limiting rotation of a wheel with a parallelogram cross section.
Figure 19:
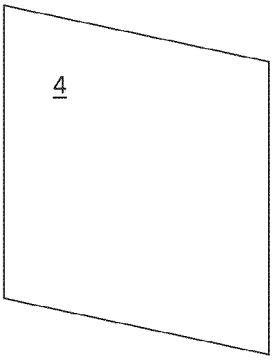
FIG. 19 is an end view of a block-type device for limiting rotation of a wheel with a parallelogram cross section.
Figure 20:
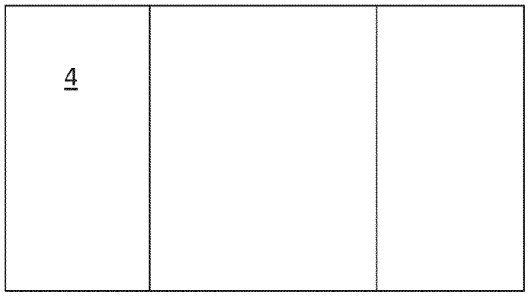
FIG. 20 is a bottom view of a block-type device for limiting rotation of a wheel with a parallelogram cross section.
Figure 21:
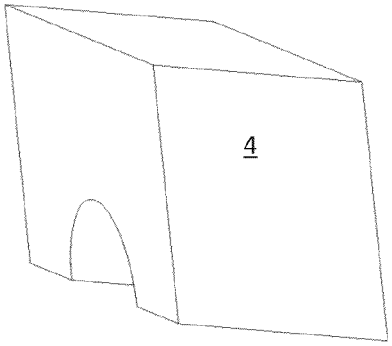
FIG. 21 is a perspective view of a block-type device for limiting rotation of a wheel with a parallelogram cross section.
Figure 22:
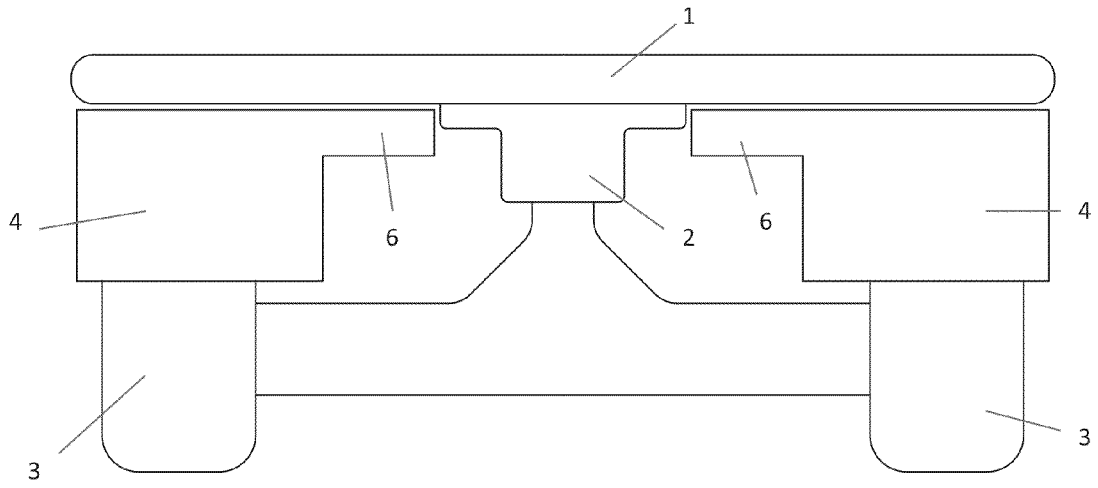
FIG. 22 is an end view of a skateboard with block-type devices for limiting rotation of a wheel with rotation stops.
Figure 23:
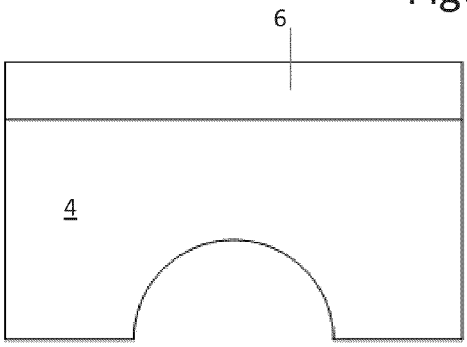
FIG. 23 is a side view of a block-type device for limiting rotation of a wheel with a rotation stop.
Figure 24:
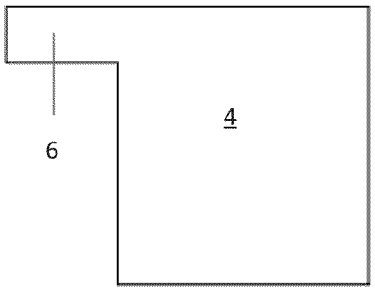
FIG. 24 is an end view of a block-type device for limiting rotation of a wheel with a rotation stop.
Figure 25:
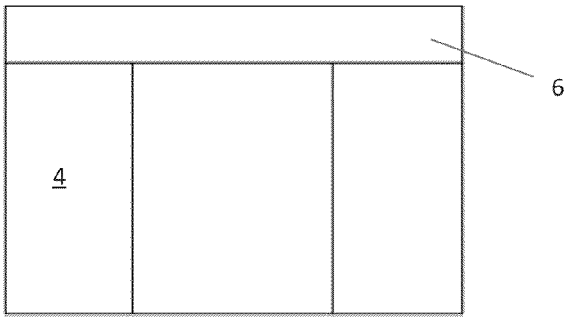
FIG. 25 is a bottom view of a block-type device for limiting rotation of a wheel with a rotation stop.

The block 4 may have any appropriate shape, the most simple being a cuboid, although it may be desirable for the block 4 to roughly mimic the shape of the space between the deck 1 and the wheel 3. As seen in FIG. 1, this space in roughly flat on top, being defined by the generally flat deck 1, and generally concave on bottom, being defined by the round wheel 3. Shaping the block 4 to similarly have a recess in the area of the wheel 3 allows for less material to compress in the smallest space between the wheel 3 and deck 1, increasing ease of installation, while providing sufficient material along the sides to provide pressure to not just the top but also the sides of the wheel 3, increasing friction on the wheel 3. Alternately, the recess may be located on the top of the block or on both the top and bottom of the block, as seen in FIG. 7, allowing the block to conform around the wheel. The recess may have any appropriate shape, as seen in FIGS. 2 through 4. The block 4 may additionally have cut-outs, providing greater flexibility, as seen in FIGS. 5 and 6. The block 4 may have any appropriate cross section, such as a square cross section, as seen in FIGS. 8 through 11; an angled cross section, as seen in FIGS. 12 through 16; or a parallelogram cross section, as seen in FIGS. 17 through 21. The block 4 may additionally have a protrusion 6 extending inward toward the truck 2 to function as a stop and prevent the block 4 from rotating laterally as the wheel 3 attempts to rotate.

Different sizes of the block 4 may be used to vary the degree of rotation allowed. This allows different blocks 4 to be used for different skill levels. Once a rider progresses, he or she may advance by using blocks 4 that allow for limited wheel rotation. Additionally, blocks 4 may be used on any number of wheels 3, from one to all, to vary training difficulty and allow for more or less rotation.

Material for the block 4 may vary depending upon user requirements, such as different stiffnesses, changes in surface friction, reduced weight, increased durability, etc. Friction coating may be added where the block 4 contacts the wheel 3 to stop wheel rotation while minimizing preload, thus reducing the effort required to install. Additionally, not coating the other surfaces may result in minimizing the friction where the block 4 contacts the deck 1, which also reduces the installation forces required.

The block 4 is light, portable, and temporary, can be installed without tools, and allows the rider to use his own equipment, with the actual wheels maintaining contact with the ground. Added mass is insignificant relative to the mass of the skateboard, and significantly less than other solutions currently available. Any added mass is near the center of gravity of the skateboard, resulting in insignificant changes to the dynamic rotational properties of the skateboard assembly. Another advantage is that one size of the block 4 may work with a variety of skateboard dimensions and configurations. The skateboard does not have to be disassembled to install the block 4, which is an advantage over several currently available skateboard training devices. Several variations may use the wheel 3 for leverage to facilitate easy installation. The block 4 does not generally come into contact with the ground or other surfaces, minimizing wear. The block 4 does not cover or prevent access to the center, nose, or tail areas of the board, allowing for contact to surfaces and obstacles such as rails, stairs, or platforms. A secondary benefit of the block 4 is that it may decrease the flexibility that results in rotation of the skateboard deck about the long axis (the forward/aft axis), which helps stabilize the skateboard while learning certain tricks and training for balance. Finally, the blocks 4 may be used on skateboard assemblies in retail environments, sold as part of the packaging to prevent use while in store or during transportation.

Figure 26:
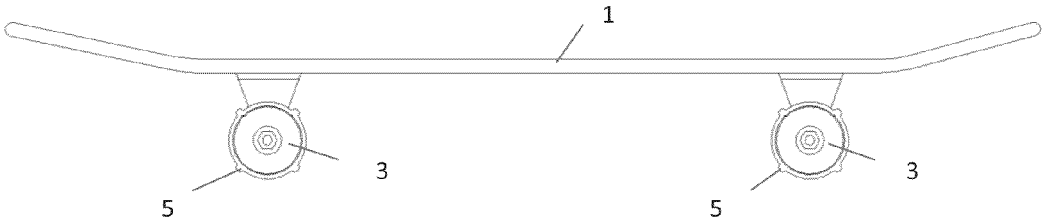
FIG. 26 is a side view of a skateboard with chock-type devices for limiting rotation of a wheel.
Figure 27:
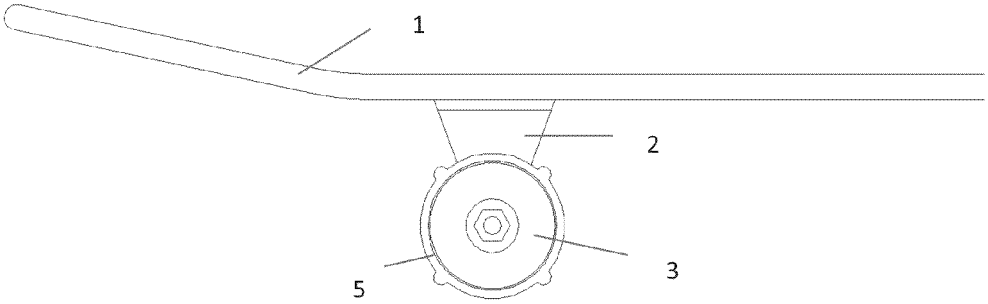
FIG. 27 is a close-up side view of one end of a skateboard with a chock-type device for limiting rotation of a wheel.
Figure 28:
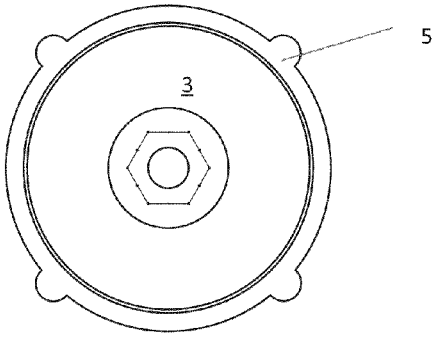
FIG. 28 is a side view of a wheel with a chock-type device for limiting rotation of a wheel with rounded protrusions.

As seen in FIGS. 26 and 27, the device may be a wheel-mounted chock-type device 5 that surrounds a wheel 3 and has protrusions at various intervals. When the wheel 3 is in contact with a surface, the protrusions act as chocks as the wheel 3 tries to turn, limiting rotation of the wheel 3. The chock-type device 5 may mount to the wheel 3 itself and be independent of the deck 1 and trucks 2. The chock-type device 5 may be made of an elastic material capable of stretching for easy placement around the wheel 3 but conforming to the shape of the wheel to fit securely around the wheel 3, preventing the wheel 3 from rotating without the device 5 also rotating.

Figure 29:
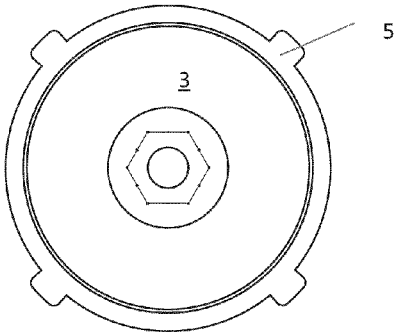
FIG. 29 is a side view of a wheel with a chock-type device for limiting rotation of a wheel with rectangular protrusions.
Figure 30:
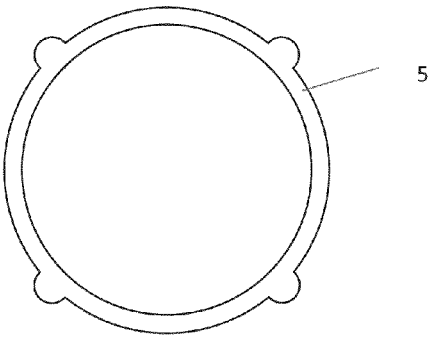
FIG. 30 is a side view of a chock-type device for limiting rotation of a wheel with rounded protrusions.
Figure 31:
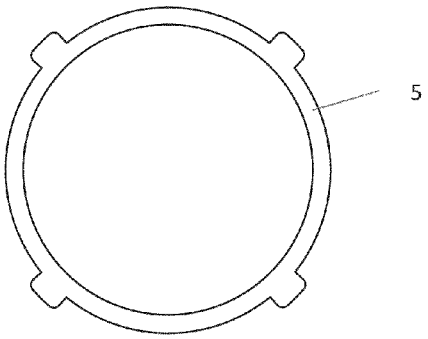
FIG. 31 is a side view of a chock-type device for limiting rotation of a wheel with rectangular protrusions.
Figure 32:
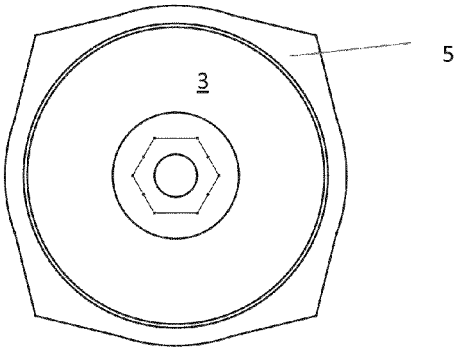
FIG. 32 is a side view of a wheel with a chock-type device for limiting rotation of a wheel with angled protrusions.
Figure 33:
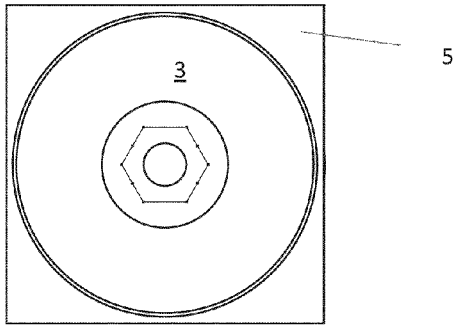
FIG. 33 is a side view of a wheel with a chock-type device for limiting rotation of a wheel with a rectangular outer contour.
Figure 34:
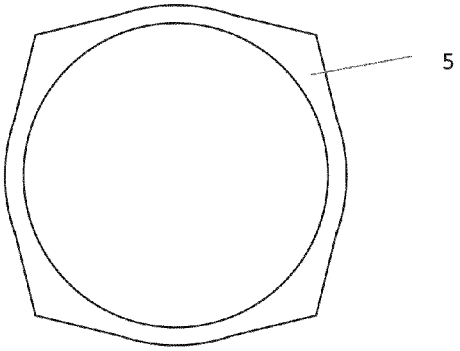
FIG. 34 is a side view of a chock-type device for limiting rotation of a wheel with angled protrusions.
Figure 35:
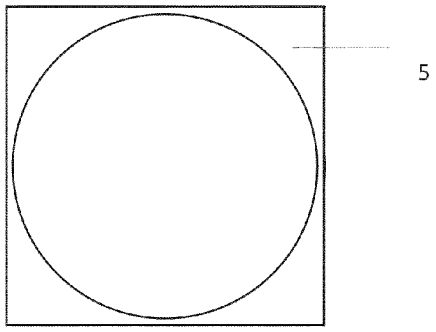
FIG. 35 is a side view of a chock-type device for limiting rotation of a wheel with a rectangular outer contour.
Figure 36:
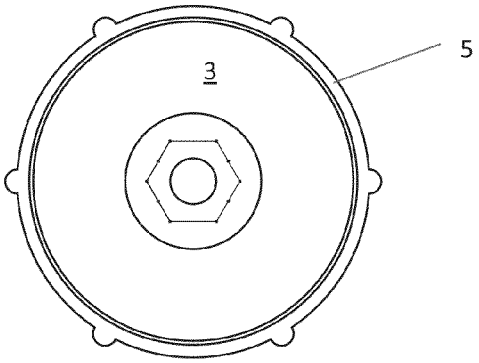
FIG. 36 is a side view of a wheel with a chock-type device for limiting rotation of a wheel with rounded protrusions.
Figure 37:
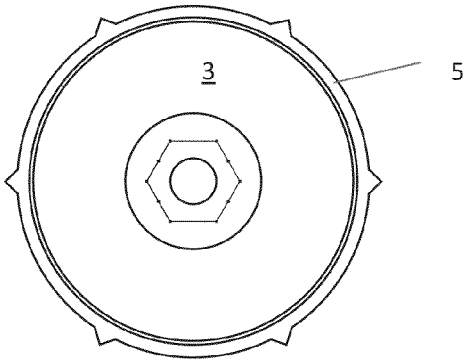
FIG. 37 is a side view of a wheel with a chock-type device for limiting rotation of a wheel with triangular protrusions.
Figure 38:
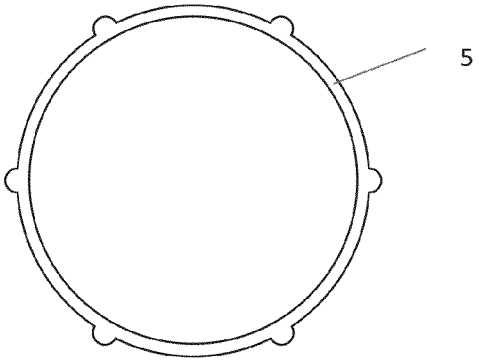
FIG. 38 is a side view of a chock-type device for limiting rotation of a wheel with rounded protrusions.
Figure 39:
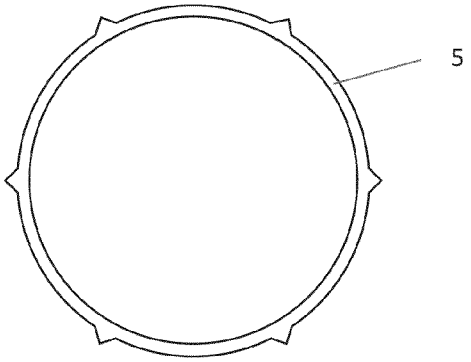
FIG. 39 is a side view of a chock-type device for limiting rotation of a wheel with triangular protrusions.
Figure 40:
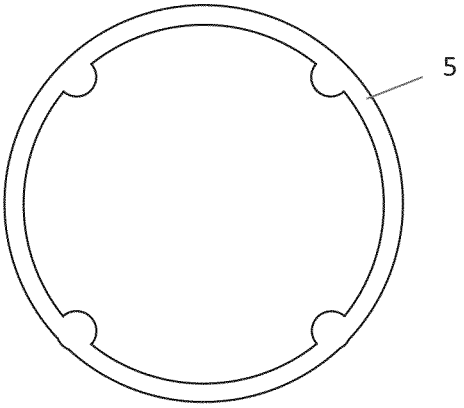
FIG. 40 is a side view of a chock-type device for limiting rotation of a wheel with interior protrusions.
Figure 41:
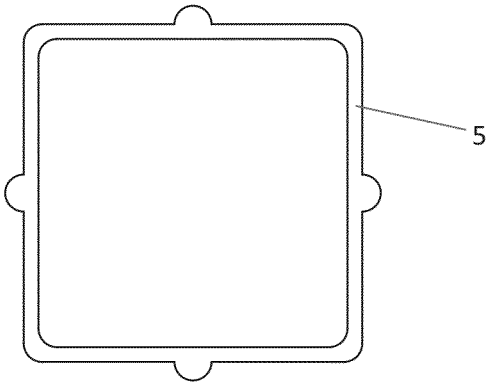
FIG. 41 is a side view of a rectangular chock-type device for limiting rotation of a wheel.
Figure 42:
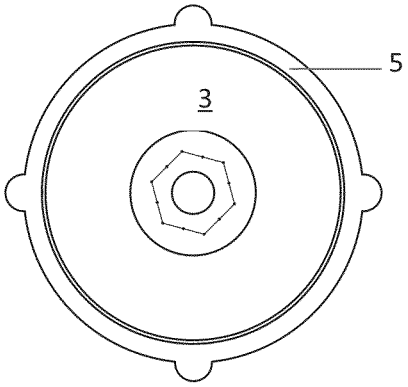
FIG. 42 is a side view of a wheel with a rectangular chock-type device for limiting rotation of a wheel.

The chock-type device 5 may have any number of protrusions, including four, as seen in FIGS. 26 through 35; six, as seen in FIGS. 36 through 39; or any other desired number. The protrusions of the chock-type device 5 may have any shape, such as rounded, as seen in FIGS. 26, 28, 30, 36, and 38; rectangular, as seen in FIGS. 29 and 31; or triangular, as seen in FIGS. 37 and 39. The chock-type device 5 may have a rounded interior cross section to accommodate the wheel 3, but an angular or rectangular outer cross section, as seen in FIGS. 32 and 34 and FIGS. 33 and 35, respectively, to prevent rotation of the device 5 against a surface. The protrusions may be located on the outer surface of the chock-type device 5, as seen in FIGS. 26 through 39, or may be located on the inner surface of the device 5, as seen in FIG. 40. The device 5 may have any desired cross sectional shape, such as rectangular as seen in FIG. 41, but may deform to fit the cylindrical wheel 3, as seen in FIG. 42.

Figure 43:
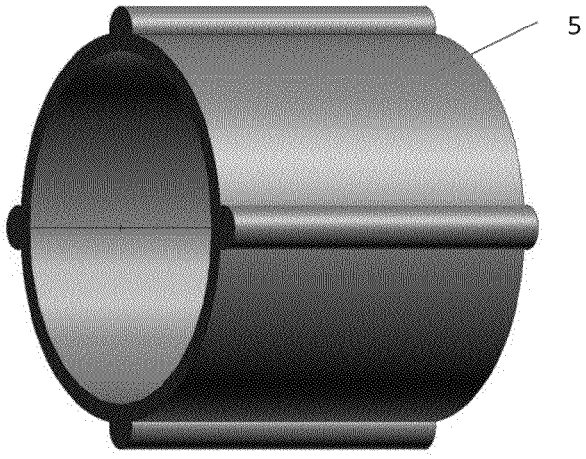
FIG. 43 is a perspective view of a chock-type device for limiting rotation of a wheel.
Figure 44:
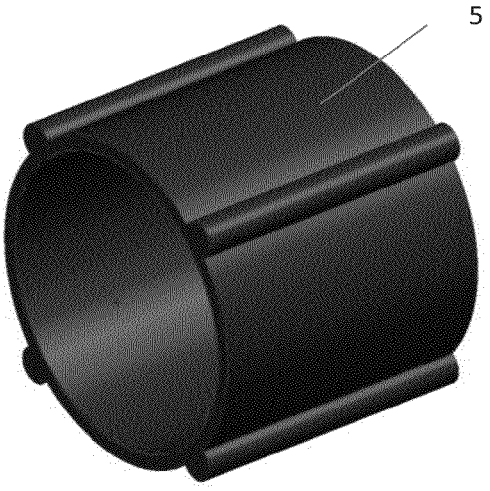
FIG. 44 is a perspective view of a chock-type device for limiting rotation of a wheel.
Figure 45:
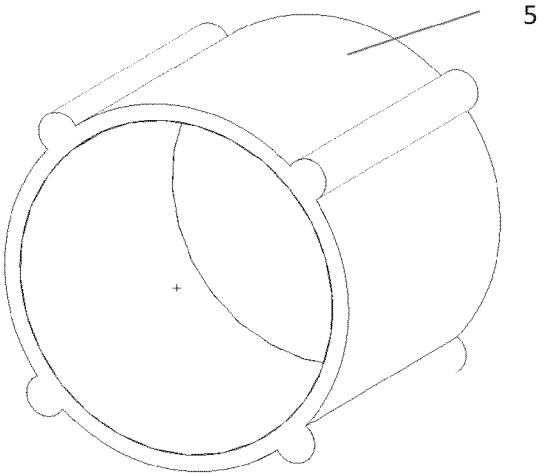
FIG. 45 is a perspective view of a chock-type device for limiting rotation of a wheel.
Figure 46:
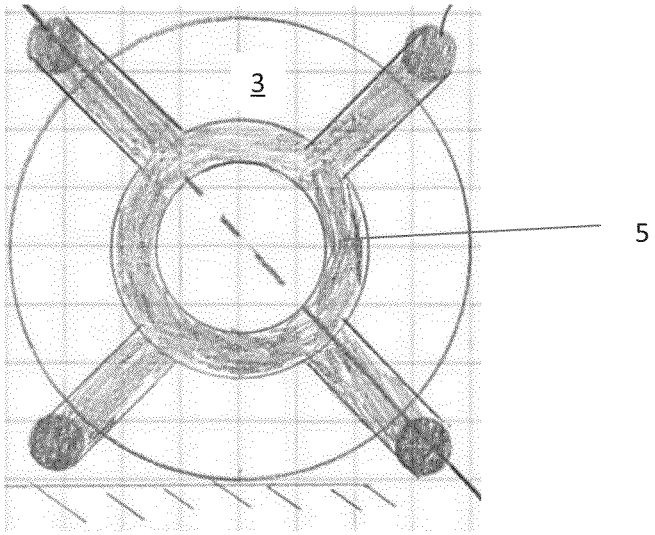
FIG. 46 is a side view of a wheel with a chock-type device for limiting rotation of a wheel with a cage design.
Figure 47:
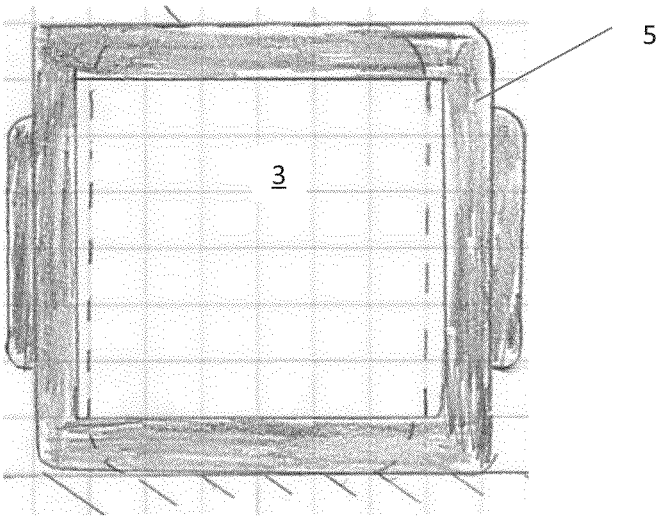
FIG. 47 is an end view of a wheel with a chock-type device for limiting rotation of a wheel with a cage design.
Figure 54:
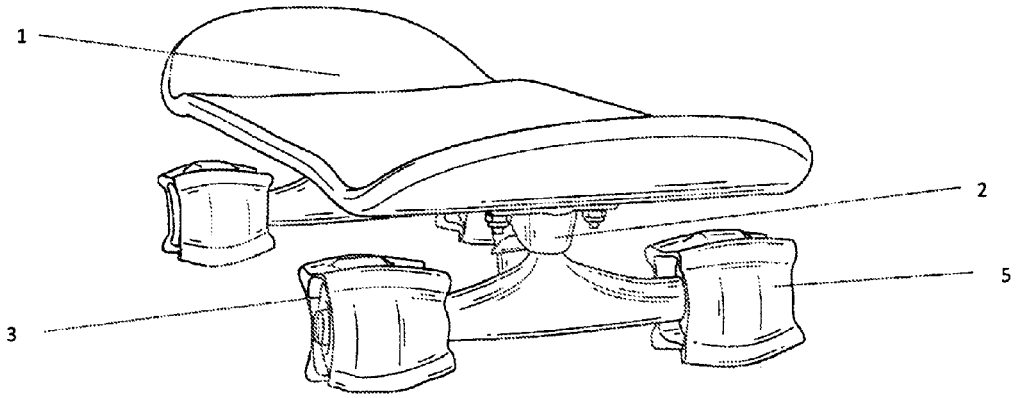
FIG. 54 is a perspective view of a wheel with a chock-type device for limiting rotation of a wheel installed thereon.
Figure 55:
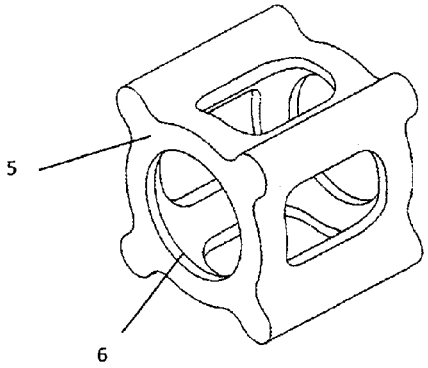
FIG. 55 is a perspective view of a flanged version of a chock-type device for limiting rotation of a wheel.
Figure 56:
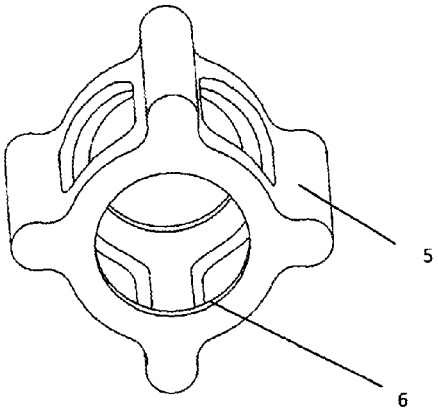
FIG. 56 is another perspective view of a flanged version of a chock-type device for limiting rotation of a wheel.

As seen in FIGS. 43 through 56, the chock-type device 5 may be generally cylindrical with the protrusions running crosswise along the width of the surface of the chock-type device 5, perpendicular to the path of rotation of the wheel 3. In this configuration, the chock-type device 5 may be placed onto the wheel 3 from the side. Alternately, the chock-type device 5 may be placed onto the wheel 4 from the top or bottom, as appropriate. As seen in FIGS. 43 through 45, the space between the protrusions may be solid; alternately, as seen in FIGS. 46 through 53, there may be openings in the spaces between the protrusions. In particular, as seen in FIGS. 46 and 47, an alternate design of chock-type device 5 surrounds the wheel 3 from the sides, with the protrusions extending between the sides. In this configuration, the chock-type device 5 may be placed onto the wheel 3 from the side, top, or bottom, or through one of the gaps between the protrusions. The ends of the chock-type device 5 may have shoulders 6, as seen in FIGS. 55 and 56, to facilitate retention of the chock-type device 5 on the wheel 3.

Figure 48:
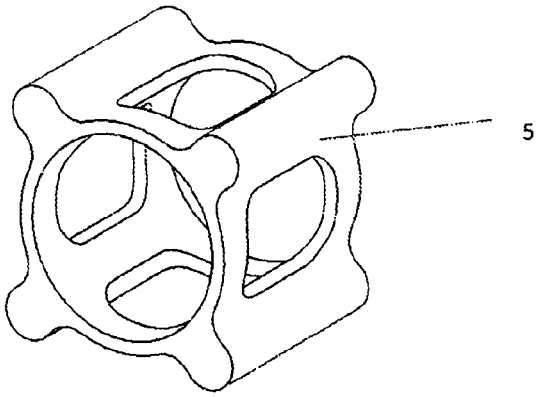
FIG. 48 is a perspective view of the chock-type device for limiting rotation of a wheel.
Figure 49:
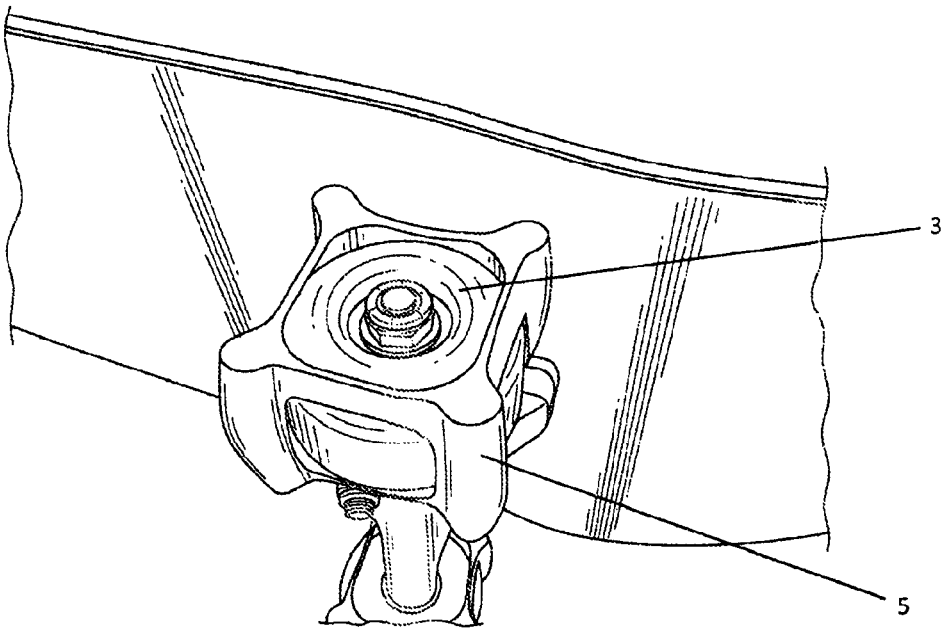
FIG. 49 is a perspective view of a wheel with a chock-type device for limiting rotation of a wheel installed thereon.
Figure 50:
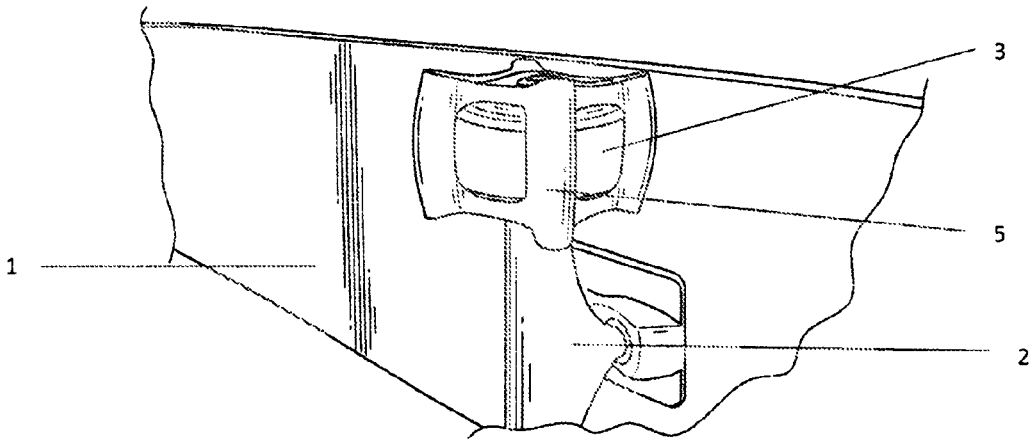
FIG. 50 is a perspective view of a wheel with a chock-type device for limiting rotation of a wheel installed thereon.
Figure 51:
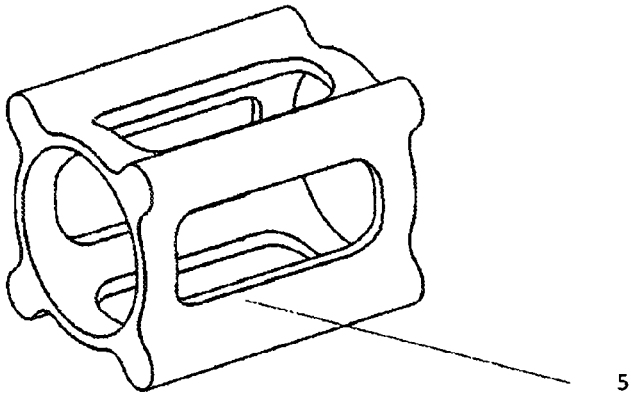
FIG. 51 is a perspective view of a chock-type device for limiting rotation of a wheel with an alternate design.
Figure 52:
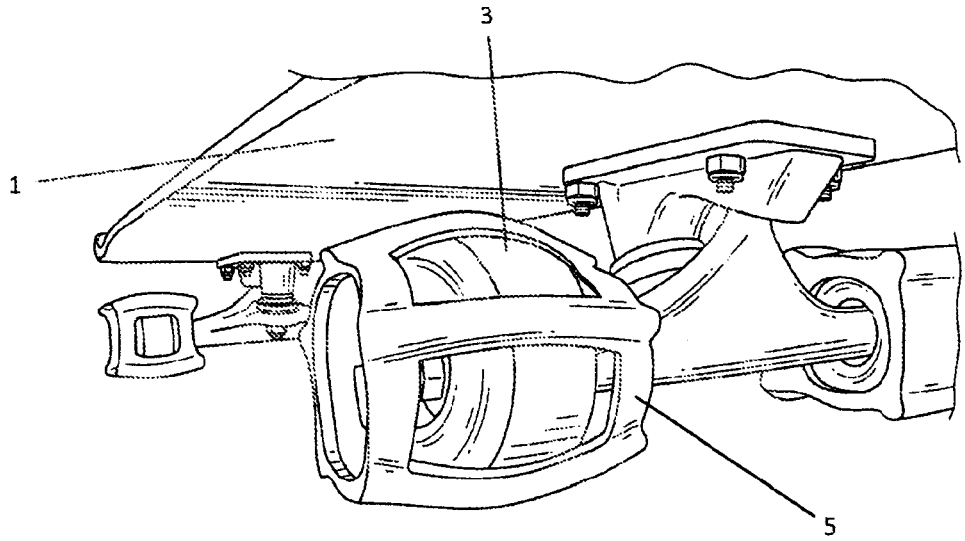
FIG. 52 is a perspective view of a wheel with a chock-type device for limiting rotation of a wheel with an alternate design installed thereon.
Figure 53:
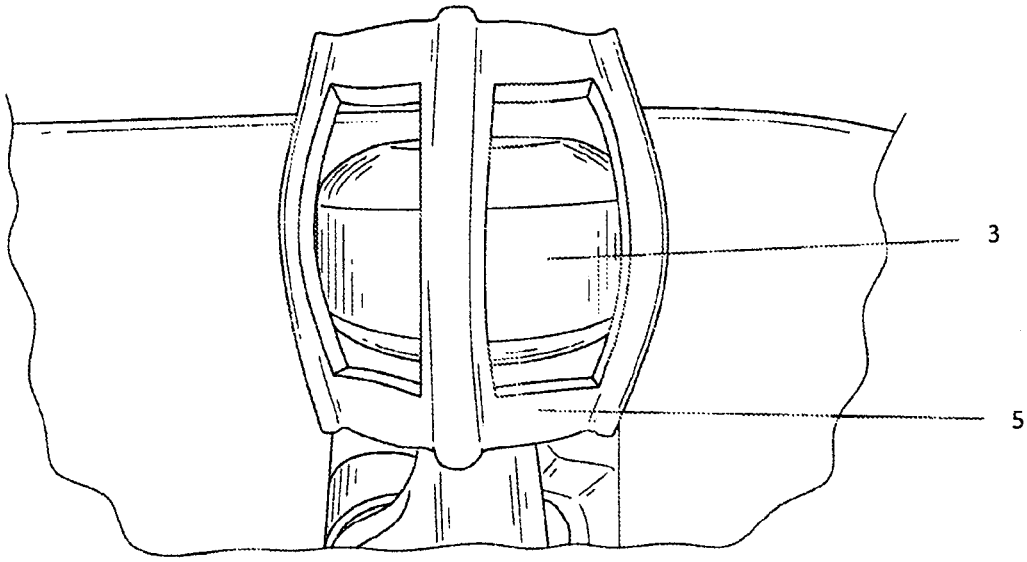
FIG. 53 is a perspective view of a wheel with a chock-type device for limiting rotation of a wheel with an alternate design installed thereon.

The configuration shown in FIGS. 48 through 53 may fit closely on the wheel, as in FIGS. 48 through 50, or may be sized wider than the wheel to loosely surround the wheel, as in FIGS. 51 through 53.

The chock-type device 5 may not prevent rotation of the wheel 3 when not in contact with a surface, but may allow the wheel 3 to freely rotate until it comes into contact with a surface.

In general, the chock-type device 5 may be flexible so that it can be stretched over a range of skateboard wheel diameters and widths. The chock-type device 5 may be designed so that friction and subsequent abrasion from the riding surface does not quickly wear the part out. It is desirable for the chock-type device 5 to avoid frequently departing the wheel during use, such as from striking the ground or twisting the skateboard. The retention may be accomplished through preload from stretching over the wheel, the coefficient of friction of the wheel chock material at the wheel interface, and design features that allow the device to self-center on the wheel as it comes into contact with the ground, or any combination of these. The key is that the chock-type device 5 prevents or limits rotation of the wheel when the wheel is in contact with the ground.

The chock-type device 5 shares the majority of the advantages of the block 4, with even more universality. Additionally, the chock-type device 5 does not influence the flexibility of the skateboard. The chock-type device 5 is light, portable, and temporary, can be installed without tools, and allows the rider to use his own equipment. The chock-type device 5 has low mass, which results in insignificant changes to the mass properties of the skateboard assembly. The mass is not significant relative to the skateboard assembly, and also is considerably less than other currently available products. The mass of the chock-type device 5 is added to the wheels 3, and thus does not change the dynamic rotational properties of the skateboard assembly. The chock-type device 5 also does not change the flexibility of the skateboard deck 1/truck 2 combination at all, allowing the rider to adapt to the feel and weight of their own skateboard, rather than a separate training apparatus or a device that alters the skateboard flexibility. The chock-type device 5 does not require one to disassemble a skateboard to install. It does not cover or prevent access to the center, nose, or tail areas of the board, allowing for contact to surfaces and obstacles such as rails, stairs, or platforms. The chock-type device 5 is portable, and is so small and flexible that it can be carried in a shirt or pants pocket, allowing for easy transport while riding a skateboard. Anywhere from one to four chock-type devices 5 may be used to vary training difficulty, or to allow for more or less maneuvering of the skateboard. Finally, the chock-type device 5 may be used on skateboard assemblies in retail environments, sold as part of the packaging to prevent use while in a store or during transportation.

There are three specific design iterations discussed that have been manufactured and tested. Concept 1 is a cylinder design, as seen in FIG. 54. This is one variation on the chock-type device discussed above. Concept 1 involves a simple section that covers the entire wheel's riding surface with a finite number of bumps and a band that connects all the bumps together, forming a continuous part. The cross section is uniform over entire length of the part, meaning there are no holes in the part. The device has protrusions to prevent or limit the wheel rotation. When a wheel is resting or in contact with the ground, the "band" section between the bumps rests on the riding surface. The part can be any width, but works best if it is wider than the wheel ground contact surface so that the preload and deformations from installation creates a shape that pushes on the sides of the wheel to enhance retention during use.

Concept 2 is a cage design, and functions the same as concept 1. Concept 2 could be construed as Concept 1 with holes in the bands where they would contact the wheel riding surface, as seen in FIGS. 48 through 50. When installed, the now narrow bands connecting the bumps conform to the edges of the wheel, and not the riding surface. This enhances the wear life of the part, because the wheel is the primary element in contact with the ground, and not the band. This also enhances the retention, because the straps conform to the sides of the wheels and there are less forces acting on the part pushing it off the wheel because the part straps are not usually in contact in the ground. The bands are considerably more narrow, which can potentially make installation much easier. The grip on the wheel can be improved because the entire preload from stretching is concentrated on the sides of the wheels, making it more difficult for the part to slip off during use.

Concept 2a is an extended cage design, as seen in FIGS. 51 through 53. It is a wider version of concept 2. This potentially enhances the retention of the part to the wheel, makes for easier installation due to increased part flexibility in the installation mode, and allows for installation on a wider range of wheel diameters and widths. It is easier to install because of the flexibility of the longer bumps. The mechanism for retaining the device in place is less reliant on preload. Because the part is a much more loose fit and because the part is wider, shifts in the location relative the wheel are less like to result in departure from the wheel during use.

Whereas, the devices and methods have been described in relation to the drawings and claims, it should be understood that other and further modifications, apart from those shown or suggested herein, may be made within the spirit and scope of this invention.

What is claimed is:

1. A device for use with a wheeled device comprising a deck and at least one wheel attached to the deck with a gap between the wheel and the deck, the device comprising:

a physical stop secured against one wheel of the wheeled device, where the physical stop comprises a block of resilient material, where the block is thicker than the gap between the wheel and the deck and is capable of being placed in a semi-compressed or compressed state into the gap such that the block exerts pressure on the wheel sufficient to prevent the wheel from freely rotating, and where the block has at least one surface with a coating having at least one physical characteristic different from that of the block.

2. The device of claim 1 where the wheeled device is a skateboard.

3. The device of claim 1 where the wheeled device comprises multiple wheels, the device comprising multiple physical stops, each physical stop secured against one wheel.

4. The device of claim 1 where the block is generally parallelepiped-shaped with a recess corresponding to the wheel's location when the block is in place in the gap.

5. The device of claim 4 where the block has an angled top surface.

6. The device of claim 1 where the block is wider than the wheel.

7. The device of claim 1 where the block has cut out areas running horizontally through the block.

8. The device of claim 1 where the block has a bottom surface in contact with the wheel and where the bottom surface has a coating of a material with a higher coefficient of friction than the block.

9. A device for use with a wheeled device comprising a deck and at least one wheel attached to the deck with a gap between the wheel and the deck, the device comprising:

a physical stop secured against one wheel of the wheeled device, where the physical stop comprises a block of resilient material, where the block is thicker than the gap between the wheel and the deck and is capable of being placed in a semi-compressed or compressed state into the gap such that the block exerts pressure on the wheel sufficient to prevent the wheel from freely rotating, and where the wheeled device further comprises a truck attaching the wheel to the deck and where the block further comprises a protrusion extending from the block toward and touching the truck such that the protrusion prevents lateral rotation of the block.

10. The device of claim 9 where the block is generally parallelepiped-shaped with a recess corresponding to the wheel's location when the block is in place in the gap.

11. The device of claim 10 where the block has an angled top surface.

12. The device of claim 9 where the wheeled device comprises multiple wheels, the device comprising multiple physical stops, each physical stop secured against one wheel.

13. The device of claim 9 where the block is wider than the wheel.

14. The device of claim 9 where the wheeled device is a skateboard.

15. The device of claim 9 where the block has cut out areas running horizontally through the block.

16. The device of claim 9 where the block has at least one surface with a coating having at least one physical characteristic different from that of the block.

17. A device for use with a wheeled device comprising a deck and at least one wheel attached to the deck with a gap between the wheel and the deck, the device comprising:

a physical stop secured against one wheel of the wheeled device;

a holder at least partially surrounding the wheel; and at least one protrusion from the holder, where the protrusion is adjacent a rolling surface of the wheel and is capable of functioning as a chock when the protrusion is in contact with a surface upon which the wheel is attempting to roll and where the holder secures the protrusion to the wheel such that the protrusion moves with the wheel.

18. The device of claim 17 where the holder is generally cylindrical prior to installation on the wheel and surrounds the rolling surface of the wheel.

19. The device of claim 17 where the holder is made of an elastic material capable of deforming for placement around the wheel but conforming to the shape of the wheel to fit securely around the wheel such that the holder prevents the wheel from rotating when on a surface.

20. The device of claim 17 where the holder has an inner surface with a generally cylindrical cross section and an outer surface with a generally rectangular cross section.

21. The device of claim 17 where the wheel has a width and where the protrusions run crosswise along the width of the wheel, perpendicular to a path of rotation of the wheel.

22. The device of claim 17 where the wheel has sides and where the holder surrounds the wheel from the sides, with the protrusions extending between the sides across the rolling surface of the wheel.

23. The device of claim 17 where the holder is wider than the wheel.

* * * * *